US008707510B2

(12) United States Patent
Reed, Jr.

(10) Patent No.: US 8,707,510 B2
(45) Date of Patent: Apr. 29, 2014

(54) EXTRACTION CLEANER AND CENTRIFUGAL AIR/WATER SEPARATOR THEREFOR

(75) Inventor: Charles A. Reed, Jr., Rockford, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 678 days.

(21) Appl. No.: 12/876,745

(22) Filed: Sep. 7, 2010

(65) Prior Publication Data

US 2011/0056044 A1 Mar. 10, 2011

Related U.S. Application Data

(60) Provisional application No. 61/241,232, filed on Sep. 10, 2009.

(51) Int. Cl.

| | |
|---|---|
| ***A47L 9/10*** | (2006.01) |
| ***A47L 9/20*** | (2006.01) |
| ***A47L 7/00*** | (2006.01) |
| ***B04C 3/00*** | (2006.01) |
| ***B04C 5/04*** | (2006.01) |

(52) U.S. Cl.
USPC ..... 15/353; 15/320; 55/451; 55/459.1; 55/460

(58) Field of Classification Search
USPC ..... 15/353, 320; 55/460, 459.1, DIG. 3, 451
See application file for complete search history.

(56) References Cited

U.S. PATENT DOCUMENTS

| | | | | |
|---|---|---|---|---|
| 1,568,413 | A * | 1/1926 | Peebles | 55/450 |
| 1,737,680 | A | 12/1929 | Pinkham | |
| 1,798,510 | A * | 3/1931 | Winslow et al. | 55/426 |
| 2,846,024 | A * | 8/1958 | Theodor | 55/413 |
| 3,392,418 | A | 7/1968 | Schowalter | |
| 4,167,798 | A | 9/1979 | Klugle et al. | |
| 4,175,036 | A | 11/1979 | Frykhult | |
| 4,308,134 | A | 12/1981 | Lilleker et al. | |
| 4,393,538 | A * | 7/1983 | Olson | 15/320 |
| 4,816,156 | A | 3/1989 | Brombach et al. | |
| 6,024,874 | A | 2/2000 | Lott | |
| 6,131,237 | A | 10/2000 | Kasper et al. | |
| 6,381,801 | B1 * | 5/2002 | Clemons, Sr. | 15/320 |
| 7,048,783 | B2 | 5/2006 | Ponjican et al. | |
| 7,293,324 | B2 | 11/2007 | Chui et al. | |
| 2006/0156699 | A1 | 7/2006 | Kim | |
| 2007/0067945 | A1 * | 3/2007 | Kasper et al. | 15/353 |
| 2007/0209340 | A1 * | 9/2007 | Conrad | 55/345 |
| 2007/0289267 | A1 * | 12/2007 | Makarov et al. | 55/345 |
| 2008/0216278 | A1 * | 9/2008 | Krebs et al. | 15/320 |

FOREIGN PATENT DOCUMENTS

WO 199417717 A1 8/1994

* cited by examiner

*Primary Examiner* — Bryan R Muller
(74) *Attorney, Agent, or Firm* — McGarry Bair PC

(57) ABSTRACT

An extraction cleaner comprises a fluid delivery system and a fluid recovery system. The fluid recovery system includes a centrifugal separator for separating a liquid and debris-entrained working air flow with a tangential air/water inlet, water outlet and air outlet at a lower portion of the separator. The air outlet has a vertical stand pipe that extends upwardly above the tangential air/water inlet and water outlet. The centrifugal separator can be mounted in a plurality of locations on the extraction cleaner thereby offering greater architectural flexibility.

18 Claims, 6 Drawing Sheets

EXTRACTION CLEANER AND CENTRIFUGAL AIR/WATER SEPARATOR THEREFOR

CROSS-REFERENCE TO RELATED APPLICATION

This application claims the benefit of U.S. Provisional Patent Application No. 61/241,232, filed Sep. 10, 2009, which is incorporated herein by reference in its entirety.

BACKGROUND OF THE INVENTION

1. Field of the Invention

This invention relates to wet extraction cleaners. In one of its aspects, the invention relates to a wet extraction cleaner with a centrifugal separator adapted to separate entrained liquid, foam, and debris from a working air flow during an extraction process. In another of its aspects, the invention relates to a wet extraction cleaner with a flexible architectural structure with a separate liquid separator and recovery tank. In another of its aspects, the invention relates to a wet extraction cleaner with a recovery tank that is easier to empty. In yet another of its aspects, the invention relates to a wet extraction cleaner with an air-liquid separator that minimizes foam generation of extracted fluid. In still another of its aspects, the invention relates to an extraction cleaner with a centrifugal air-liquid separator adapted to minimize the pressure drop between the working air inlet and exhaust outlet for more efficient extractor operation. In yet another of its aspects, the invention relates to a wet extraction cleaner with an air-liquid separator configured for mounting in a variety of locations on an extraction cleaning machine, including mounting to or near a fluid recovery tank, or alternatively mounted remotely from the recovery tank such as on an upright handle portion separated from the fluid recovery tank. In still another of its aspects, the invention relates to a wet extraction cleaner having a relatively low profile of an air-water separator and recovery tank.

2. Description of the Related Art

Extractors are well-known suction cleaning devices used for deep cleaning carpets and other fabric surfaces, such as upholstery. Most carpet extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. The fluid delivery system can optionally include valves and/or pump assemblies for mixing and/or pressurizing the fluid for application by the fluid distributor.

The fluid recovery system typically comprises a recovery tank assembly, a suction nozzle positioned at the surface to be cleaned and in fluid communication with the recovery tank via a working air conduit, and a suction source in fluid communication with the recovery tank. The recovery tank assembly typically comprises an air-liquid separator configured to separate entrained liquid from a working air flow to prevent liquid ingestion into the suction source. An example of an upright extractor having representative fluid delivery and fluid recovery systems is disclosed in U.S. Pat. No. 6,131,237 to Kasper et al., which is incorporated herein by reference in its entirety.

U.S. Pat. No. 7,293,324 to Chui et al. discloses a wet/dry vacuum cleaner with a centrifugal flow air-liquid separator that includes a liquid collection chamber integral with and below the cylindrical separator and a controller in the liquid collection chamber to stop operation of a suction source when the liquid level within a liquid collection chamber rises to a predetermined level. The separation chamber comprises a cylindrical housing having a tangential inlet and a cylindrical wall that guides the liquid-entrained air in a circular path around the internal perimeter of the cylindrical housing. An exhaust outlet conduit of the separation chamber extends upwardly from an upper end of the separation chamber and is in communication with a remote suction source. The cylindrical collection chamber is disposed below the separation chamber and further comprises a float assembly adapted to move vertically along the inside wall to actuate a microswitch that selectively disconnects power to a vacuum motor when the fluid in the collection chamber rises to a predetermined level.

U.S. Pat. No. 7,048,783 to Ponjican et al. discloses a centrifugal flow air-liquid separator for a wet/dry vacuum cleaner. The separator comprises a separation housing having an open bottom that forms a liquid and debris outlet and further includes an exhaust standpipe protruding from the top wall and defining a dry air exhaust conduit therethrough. The exhaust standpipe is fluidly connected to a suction source mounted on top of the separator. The separator further comprises an offset inlet that is tangentially disposed at an upper portion of the housing. The inlet further comprises a lead-in track that extends from the inlet and at least partially around the circumference of the separator chamber to guide the incoming air-liquid mixture in a downward spiraling flow path toward the separator outlet and into a fluid collection chamber.

U.S. Pat. No. 1,568,413 to Peebles discloses a centrifugal steam entrainment-trap separator comprising a conical casing with a vapor discharge pipe extending upwardly through the center of the bottom wall and configured for connection to a remote vacuum source. The separator further comprises a liquid discharge duct connected to the bottom wall of the separator casing. A tangential working air inlet pipe is positioned near the lower portion of the casing. The separator is said to separate liquid-foam mixtures commonly encountered during various industrial processes such as milk evaporation and plant tannin extraction. In use, a liquid and foam mixture is delivered to the separator at high velocity where a combination of the swirling action, gravity, and friction against the tapered casing walls effectively breaks up the foam bubbles and separates the liquid from the vapor. The separated liquid exits the separator through the liquid discharge duct protruding from the bottom wall while the exhaust air exits the separator via the vapor discharge pipe.

U.S. Patent Application Publication No. 2006/0156699 to Kim discloses a cyclonic separator for a dry vacuum cleaner having a tangential inlet disposed at a lower portion of the separator housing. An exhaust pipe protrudes upwardly through the center of the separator bottom wall and has an open top thereby forming an exhaust conduit that is fluidly connected to a remote suction source. A dirty air flow is introduced into the separator through the inlet and swirls along the inside wall of the separator housing. Debris is centrifugally separated from the air stream and deposited into a cylindrical collection chamber surrounding the separation chamber. Exhaust air flows downwardly through the exhaust pipe to a suction source.

U.S. Pat. No. 3,776,385 to Maciula et al. discloses a hydrocyclone for separating heavier liquids and solids from a lighter liquid medium. The hydrocyclone comprises an upright cylindrical portion and a tangential liquid inlet fluidly connected thereto through. The cylindrical portion is closed by a top having an outlet. A downwardly-tapering conical portion having an upper diameter slightly less than that of the cylindrical portion is positioned coaxially within the cylindrical portion to define an annular space between the conical portion and cylindrical portion. In operation, a mixture of two immiscible liquids with some solids is injected into the hydrocyclone, and separated by centrifugally forces by movement of the heavier liquids and some larger solid particles outwardly towards the cylindrical wall and downwardly through the annular space into an underflow pot. At the same time, remaining solids entrained in the lighter liquid are separated in the conical portion and exit though a vertical opening at the bottom thereof into the underflow pot. The lighter liquid medium then flows upwardly through the outlet.

Additional examples of hydrocyclone-type separators are disclosed by U.S. Pat. Nos. 1,737,680 to Pinkham; 4,175,036 to Frykhult; 4,308,134 to Lilleker et al.; 4,816,156 to Brombach et al.; and 6,024,874 to Lott.

SUMMARY OF THE INVENTION

According to the invention, an extraction cleaning apparatus adapted for movement across a surface to be cleaned comprises a fluid delivery system including a fluid distributor and a fluid supply fluidly connected thereto. The fluid distributor is adapted to deliver cleaning fluid from the fluid supply to the surface to be cleaned. A fluid recovery system comprises a suction nozzle positioned at the surface to be cleaned and having an outlet opening, a recovery tank adapted to collect liquid and debris and having an inlet, a suction source, and a centrifugal separator.

The centrifugal separator comprises a cylindrical housing defining a separation chamber and having a separator inlet fluidly positioned at a lower portion of the cylindrical housing and connected to the suction nozzle outlet opening to provide fluid communication between the separation chamber and the suction nozzle outlet. The cylindrical housing further comprises a separator liquid outlet and an exhaust stand pipe. The separator inlet and the separator liquid outlet are positioned at a lower portion of the cylindrical housing. The separator liquid outlet is spaced from the separator inlet and in fluid communication between the separation chamber and the recovery tank inlet. The bottom portion of the separation chamber has an air outlet for exhausting air from the separation chamber. The exhaust stand pipe is within the separation chamber in fluid communication with the air outlet and extends upwardly therefrom to an open upper end to exhaust air separated from liquid in the separation chamber. A suction source is in fluid communication with the suction nozzle and the cylindrical separator to draw air and liquid from the surface to be cleaned and to pass the same into the separation chamber.

Further according to the invention, a centrifugal separator comprises a cylindrical housing defining a separation chamber; a separator inlet fluidly adapted to be connected to a suction nozzle and positioned at a lower portion of the cylindrical housing; a separator liquid outlet in a lower portion of the cylindrical housing, spaced from the separator inlet and in fluid communication between the separation chamber and the recovery tank inlet; an air outlet in a bottom portion of the separation chamber for exhausting air from the separation chamber and an exhaust stand pipe within the separation chamber in fluid communication with the air outlet and extending upwardly therefrom to an open upper end to exhaust air separated from liquid in the separation chamber.

In one embodiment, the suction source is positioned downstream of the separation chamber so that the air/water mixture is drawn into the separation chamber. In another embodiment, the suction source is positioned upstream of the separation chamber so that the air/water mixture is passed into the separation chamber under pressure.

In another embodiment, the separator inlet includes a conduit that introduces the air and liquid into the separation chamber through a side wall thereof at a tangential angle to the separation chamber through an inlet opening that forms linear edge that is perpendicular to the tangential angle of the separator inlet and parallel to a central axis of the cylindrical housing. Preferably, the inlet opening is an axially elongated rectangular aperture wherein the long dimension of the opening is parallel to the central axis of the separation chamber. In addition, the height-to-width ratio of the cross-sectional dimensions of the axially elongated rectangular inlet aperture can be in the range of 2:1 to 50:1. Preferably, the height-to-width ratio of the cross-sectional dimensions of the axially elongated rectangular inlet aperture is in the range of 20:1 to 40:1 and most preferably is about 30:1.

Further, the liquid outlet can be formed by a rectangular opening in a side wall of the cylindrical housing. In addition, the liquid outlet can also formed by a conduit that extends from the cylindrical housing at a tangential angle to the separation chamber.

In a preferred embodiment, the separator inlet is positioned higher in the separation chamber than the liquid outlet. Further, the separator inlet can be positioned about 180° from the separator liquid outlet about the cylindrical housing.

In another embodiment, the outlet stand pipe is flared outwardly at the open upper end thereof. In addition, the separator inlet can be positioned below the flared upper end of the outlet stand pipe.

The centrifugal air-liquid separator is adapted to minimize the pressure drop between the working air inlet and exhaust outlet for more efficient extractor operation.

The centrifugal air-liquid separator is configured for mounting in a variety of locations on an extraction cleaning machine, including mounting to or near a fluid recovery tank, or alternatively mounted remotely from the recovery tank such as on an upright handle portion separated from the fluid recovery tank.

Still further according to the invention, a plurality of centrifugal separators can be arranged in series or parallel configurations, or a combination thereof.

DESCRIPTION OF THE PREFERRED EMBODIMENT

Figure 1:
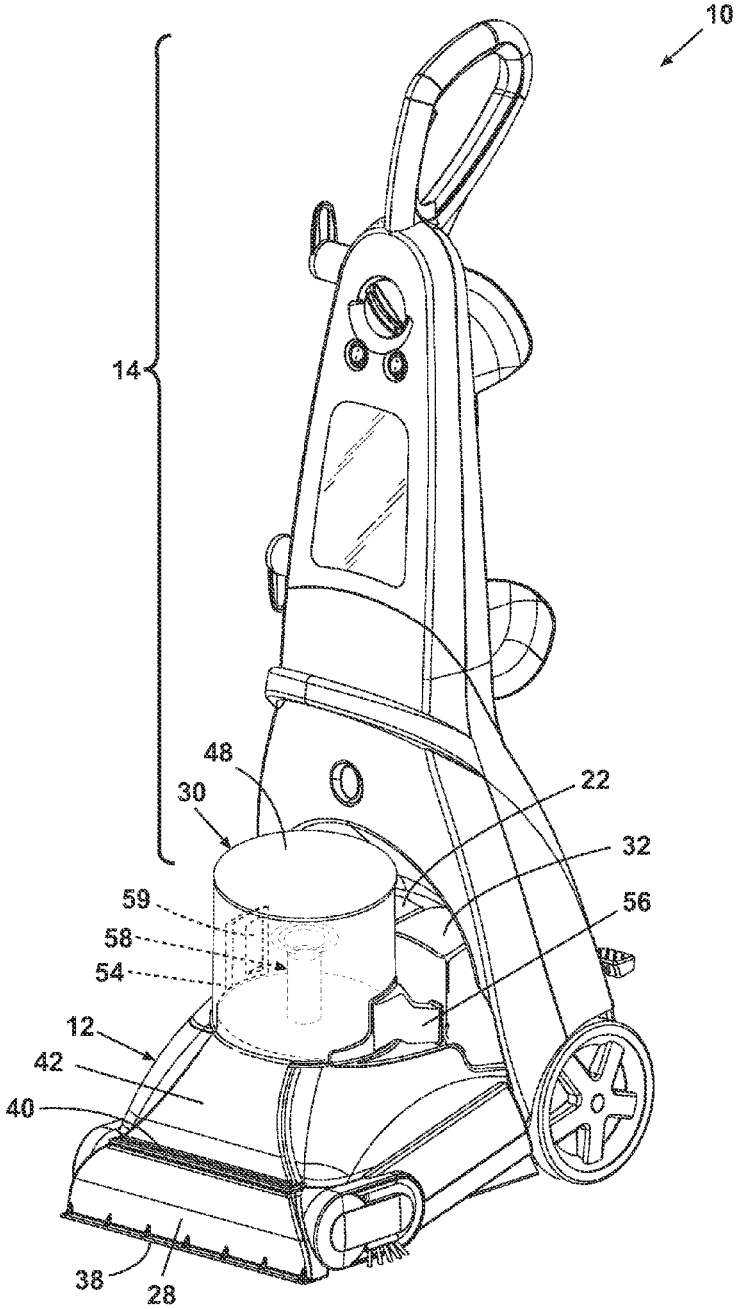
FIG. 1 is a front perspective view of an upright extractor according to the invention.
Figure 2:
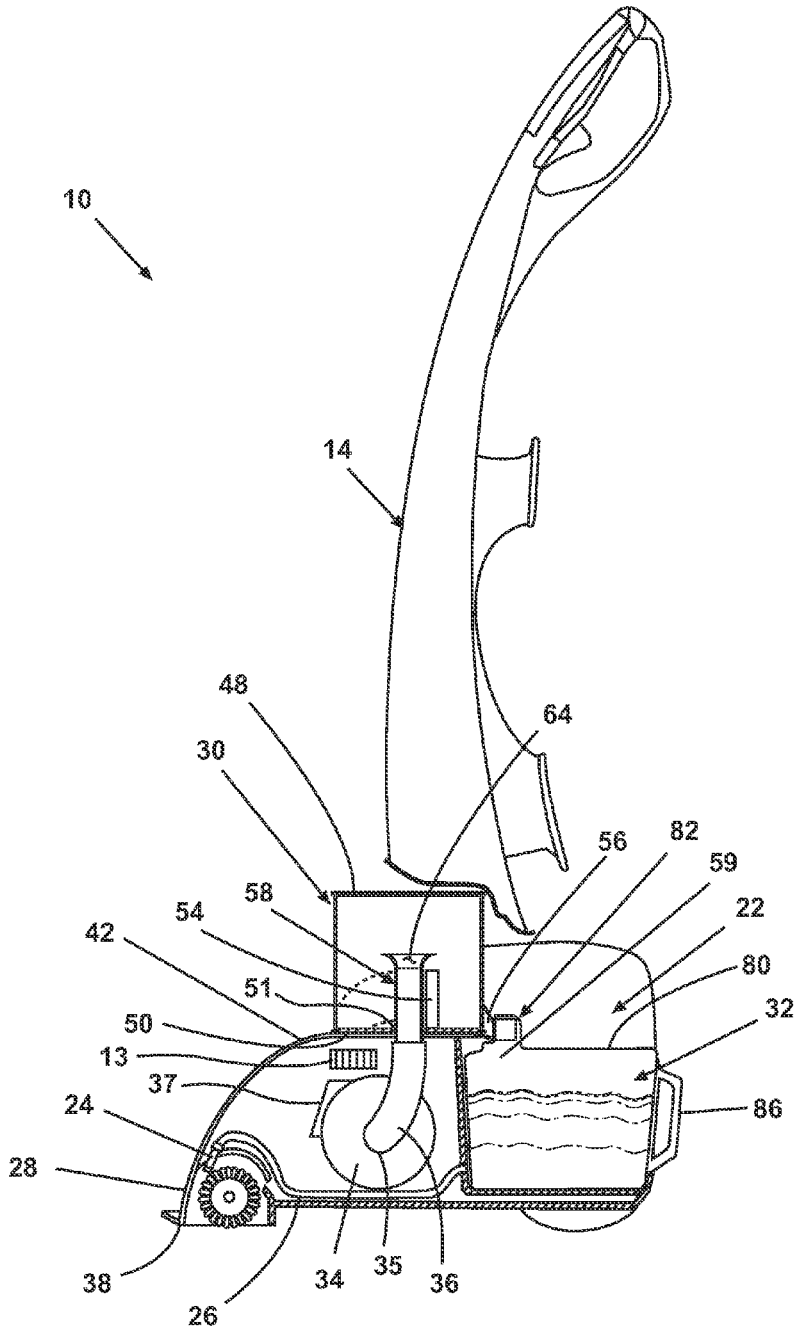
FIG. 2 is a schematic side elevational view of an upright extraction cleaning machine according to a first embodiment of the invention.
Figure 3:
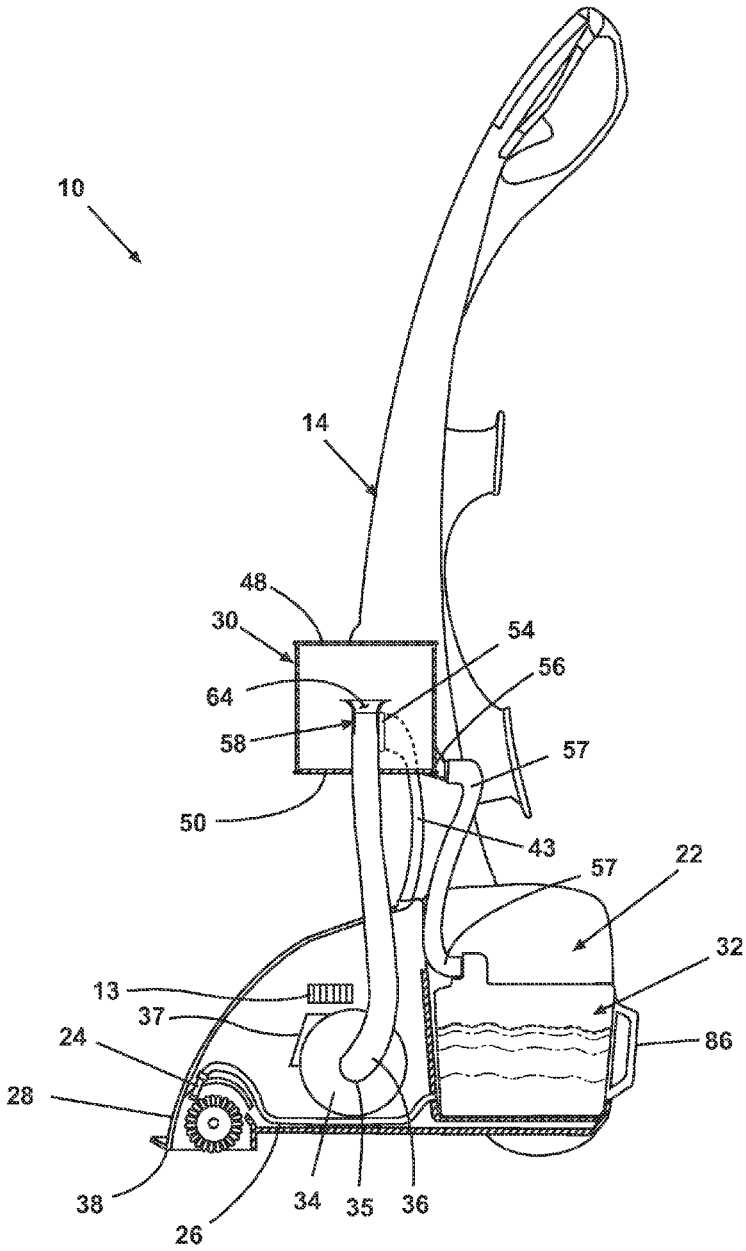
FIG. 3 is a schematic side elevational view of an upright extraction cleaning machine according to a second embodiment of the invention.

Referring to the drawings, and in particular to FIGS. 1-3, an extraction cleaner or extractor 10 comprises a foot assembly 12 and a handle assembly 14 pivotally mounted thereto for directing the foot assembly 12 across the surface to be cleaned in a well-known manner. The invention is described and illustrated herein with respect to an upright extraction cleaning machine having a conventional "clean air" bypass suction fan/motor assembly, although the invention can also be utilized in a canister-type cleaning machine and extractors having a conventional "dirty air" bypass suction fan/motor assembly. The upright extraction cleaning machine 10 is a generally well-known device comprising several of the features and operations described in U.S. Pat. No. 6,131,237 to Kasper et al. Such well-known features and operations will not be described in detail herein, except as otherwise necessary for a complete understanding of the invention.

The extractor 10 includes a fluid delivery system for storing cleaning fluid and delivering the cleaning fluid to the surface to be cleaned. The fluid delivery system comprises a fluid supply tank 22 for storing a supply of cleaning fluid, a fluid distributor 24 for applying the cleaning fluid to the surface to be cleaned, and a fluid supply conduit 26 for delivering the cleaning fluid from the fluid supply tank 22 to the fluid distributor 24. The fluid delivery system 16 can optionally include valves and/or pump assemblies (not shown) for mixing and/or pressurizing fluid to be applied through the fluid distributor 24. Optionally, the fluid delivery system can comprise a plurality of fluid supply tanks 22 to hold a variety of different cleaning or surface treatment fluids.

The extractor 10 further comprises a fluid recovery system for removing spent cleaning fluid and debris from the cleaning surface. The fluid recovery system comprises a suction nozzle 28 positioned at a surface to be cleaned and fluidly connected to an improved centrifugal separator 30 for separating entrained liquid, foam, and debris from a working air flow. The centrifugal separator 30 can be configured for mounting to the extraction cleaner 10 in a variety of different arrangements, including mounting the centrifugal separator 30 to the foot assembly 12 or to the handle assembly 14. The centrifugal separator 30 can comprise a single separator or, alternatively, a plurality of separators arranged in series, in parallel configurations, or a combination thereof. A recovery tank 32 is fluidly connected to the separator 30 for collecting the separated liquid and debris. A vacuum motor/fan assembly 34 has a fan inlet 35 that is fluidly connected to the separator 30 via an exhaust air conduit 36. The vacuum motor/fan assembly 34 further has a fan outlet 37 that exhausts air from the vacuum motor/fan assembly 34. The housing for the foot assembly has a vent 13 for venting air from the fan outlet 37 to the atmosphere. The components of the fluid delivery system and the fluid recovery system are supported by at least one of the foot assembly 12 and the handle assembly 14. A detailed description of these systems and other common extractor sub-systems and assemblies such as an agitation system, cleaning fluid mixing system, a vacuum motor/fan assembly, a fluid heater, and the like can be found in U.S. Pat. No. 6,131,237 to Kasper et al. and U.S. Patent Application Publication No. 2007/0226943 to Lenkiewicz et al. which both disclose representative extraction machines and are both incorporated herein by reference in their entirety. Various components that are not germane to this invention will not be described in detail herein.

Referring to FIG. 2, a fluid recovery system according to a first embodiment of the invention comprises a suction nozzle 28 having an inlet 38 positioned adjacent to the surface to be cleaned and an outlet 40 in fluid communication with the centrifugal separator 30 via a working air conduit 42. The centrifugal separator 30 can be located in close proximity to the suction nozzle outlet 40 such as mounted on the foot assembly 12. Alternatively, in a second embodiment of the invention shown in FIG. 3, the centrifugal separator 30 can be located remotely from the suction nozzle outlet 40. For example, the centrifugal separator 30 can be mounted on the handle assembly 14 and fluidly connected to the nozzle outlet 40 via an elongated, flexible working air conduit 43 extending therebetween. Positioning the centrifugal separator 30 on the upright handle assembly 14 instead of on the foot assembly 12 can increase overall architectural design flexibility. For example, reducing the overall foot assembly 12 size can permit lower profile foot assembly 12 designs thereby enhancing unit accessibility, including access beneath furniture and the like. Generally, the modular nature of the separator 30 permits it to be easily adapted to various extractor architectures and incorporated into machines having different aesthetic designs. Also, upon optimizing the separation performance, the modular separator design can be reused and incorporated into new product designs, thereby reducing the required overall lead time for product design, development, and testing.

Figure 4:
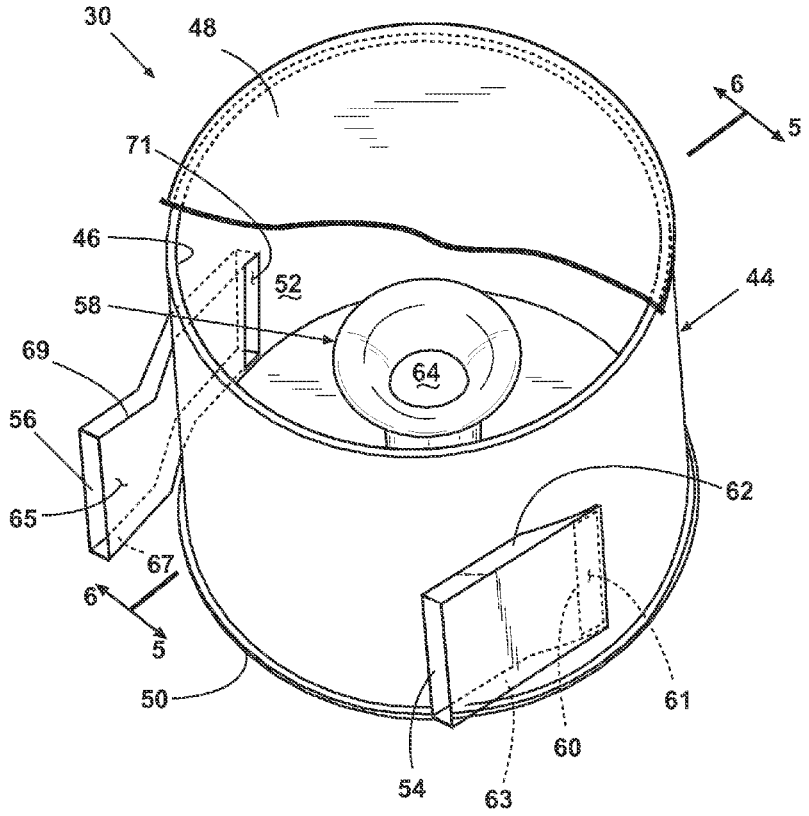
FIG. 4 is a perspective view of an air/water centrifugal separator according to the invention.
Figure 5:
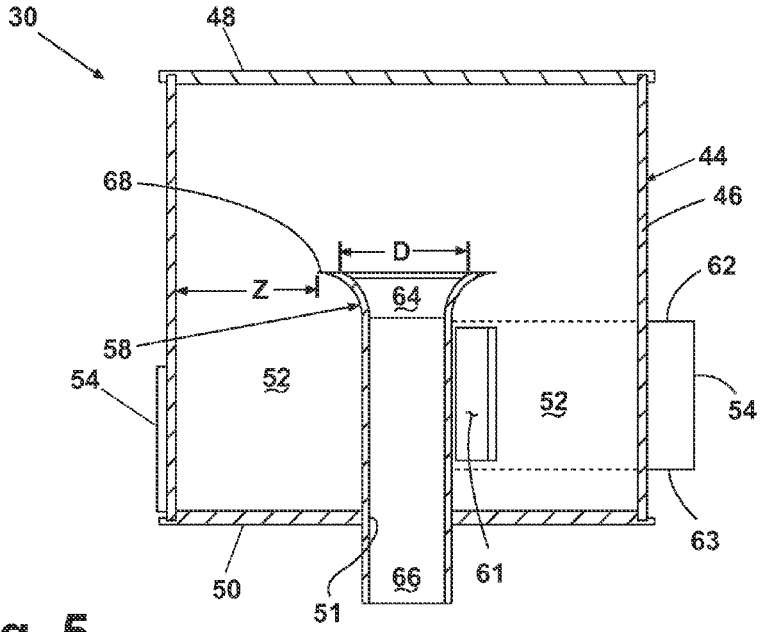
FIG. 5 is a sectional view of the air/water centrifugal separator taken along line 5-5 of FIG. 4.
Figure 6:
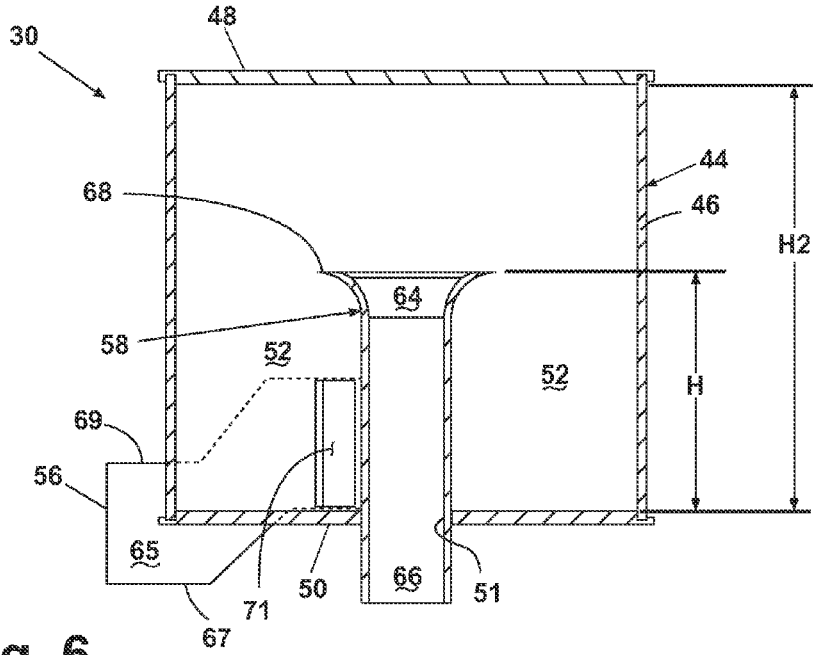
FIG. 6 is a section view of the air/water centrifugal separator taken along line 6-6 of FIG. 4.

Now referring to FIGS. 4-5, the centrifugal separator 30 comprises a cylindrical housing 44 having a cylindrical sidewall 46 with an enclosed top 48 and bottom wall 50 defining a separation chamber 52 therein. A separator inlet 54 and a separator liquid outlet 56 are tangentially disposed at a lower portion of the cylindrical housing 44. The separator inlet 54 comprises a generally vertically elongated, rectangular cross-section open conduit having two elongate vertical sidewalls 60 that are longer than the corresponding top and bottom walls 62, 63. An inlet aperture 61 of the same shape as the vertically elongated rectangular inlet 54 is formed where the separator inlet 54 joins the cylindrical sidewall 46. The bottom wall 63 of the separator inlet 54 is preferably spaced above the bottom wall 50 of the cylindrical housing 44. The top wall 62 is preferably spaced below an exhaust inlet 64, which will be described in more detail hereinafter.

The separator inlet 54 shape can directly impact separation efficacy. Although liquid inlet cross-section shapes other than the vertically elongated rectangular inlet openings such as circular, oval, square, triangular, or other non-uniform or unsymmetrical arcuate shapes can be used, an inlet opening and conduit that introduces the air and liquid into the separation chamber at a tangential angle and forms linear edge that is perpendicular to the tangential angle of the separator inlet and parallel to a central axis of the cylindrical housing, as, for example, vertically elongated rectangular inlet openings, are much preferred because these openings tend to sheet the liquid along the inner surface of the cylindrical sidewall 46. In this process, the foamed liquid/detergent mixture travels smoothly along the inside surface of the cylindrical sidewall 46 for an extended period during which the foam bubbles collapse due to the friction along the sidewall. It has been found through experimentation that separation efficiency measurably improves with the vertically elongated rectangular inlet conduit and openings into the separation chamber 52 compared with a conventional round or oval inlet openings into the chamber 52. The height-to-width ratio of the cross-sectional dimensions of the vertically elongated rectangular inlet aperture and inlet conduit 54 can vary over a range and generally are in the range of 2:1 to 50:1, preferably in the range of 20:1 to 40:1 and most preferably is about 30:1.

Further, the cross-sectional area A of the separator inlet 54 can affect parameters such as rotational velocity V of the working air flow as well as the pressure drop ΔP across the separator 30. Generally, the working air flow created during the extraction process contains a mixture of entrained water, cleaning solution, foam bubbles, dirt and debris. The working air flow must reach a minimum rotational velocity V for effective centrifugal separation of the entrained liquid, foam, and dirt. When the minimum rotational velocity V is achieved, the working air flow swirls around the separation chamber 52. The rotational flow generates an inertial centrifugal force that acts on the dense entrained material, such as liquid and debris, forcing it outwardly against the cylindrical sidewall 46, thereby generating friction which can break up entrained foam bubbles and release any entrapped air. Gravitational force also acts on the mixture and pulls denser/heavier material downwardly towards the bottom of the separator 30. The entrained liquid and debris are thereby centrifugally separated from the working air flow. The rotational velocity V of the incoming working air flow is inversely related to the cross-sectional area A of the separator inlet 54 opening such that the rotational velocity V will increase as the separator inlet cross-sectional area A is reduced if all other variables remain constant. It should be noted, however, that excessive rotational velocity V can cause excessive turbulence within the separation chamber 52, which can increase foam generation and lead to undesirable separation problems. Accordingly, a separator inlet 54 design is configured to permit adequate rotational velocity of the working air flow in order to realize effective separation while simultaneously minimizing the likelihood of excessive turbulence and foam generation is desired. With the proper dimensional parameters, the foam is forced into a sheet of rotating liquid caused by the tangential inlet and thereby forced to become incorporated into the liquid stream.

The separator inlet cross-sectional area A is also inversely related to the pressure drop ΔP across the separator 30. The pressure drop ΔP across the separator 30 is the difference between the vacuum pressure at the separator outlet $P_{outlet}$ and the vacuum pressure at the separator inlet $P_{inlet}$. Generally, if all other factors are held constant, as the separator inlet 54 size is reduced, a higher vacuum pressure is created at the outlet $P_{outlet}$, thereby increasing the pressure drop ΔP across the separator 30. Additional variables such as the size and shape of the separator exhaust can also affect the pressure drop. A minimal pressure drop across the separator 30 is desirable for ensuring efficient extractor operation. Excessive pressure drop can affect vacuum motor/fan selection and ultimately impact overall product cost and energy usage. Accordingly, it is desirable to design the separator inlet 54 to minimize the pressure drop, ΔP, while balancing fluid separation performance considerations.

A separator liquid outlet 56 protrudes tangentially, outwardly from the cylindrical sidewall 46 of the separator 30 at a lower portion thereof. The separator liquid outlet 56 comprises a rectangular cross-section conduit having elongate vertical sidewalls 65, a top wall 69, and a bottom wall 67. The liquid outlet 56 further comprises an outlet aperture 71 formed in the cylindrical sidewall 46. The bottom wall 67 of the separator liquid outlet 56 is preferably located co-planar with or below the bottom separator wall 50 to facilitate liquid drainage from the separation chamber 52. The separator liquid outlet 56 can originate from a location on the cylindrical sidewall 46 spaced from the separator inlet 54 such that inlet aperture 61 and outlet aperture 71 are diametrically opposed. Alternatively, the inlet and outlet apertures 61, 71 can be spaced within an angular range of 15-345° along the cylindrical sidewall 46. In another alternate configuration, the liquid outlet 56 can protrude downwardly from the bottom wall 50 of the separator 30. The separator liquid outlet 56 can further be configured for fluid connection to a fluid recovery tank 32 or to an intermediate fluid outlet conduit 57 that will be described in more detail hereinafter.

Referring now to FIG. 5, the centrifugal separator 30 further comprises a cylindrical exhaust stand pipe 58 extending upwardly from an exhaust opening 51 in the bottom wall 50 to an open upper end. The stand pipe 58 comprises an exhaust opening 64 formed at a top portion thereof and an exhaust outlet 66 formed at a bottom portion thereof. The stand pipe 58 protrudes upwardly from the center of the bottom separator wall 50 to a height H, which is approximately 75% of the adjacent cylindrical sidewall height, H2. Alternatively, the height H of the stand pipe 58 can be any height within a range from 30% to 95% of the cylindrical sidewall height H2. The standpipe height H can be configured to minimize potential for liquid re-entrainment in the exhaust air flow by ensuring that the exhaust inlet 64 is spaced above the top wall 62 of the separator liquid inlet 54. The exhaust outlet 66 is adapted to be fluidly connected to a remote suction source such as a vacuum/motor fan assembly 34 via any suitable combination of seals, conduits, ducts, hoses or the like (not shown).

As shown in FIG. 5, the exhaust stand pipe inlet 64 can comprise an outwardly flared end 68. The flared end 68 comprises an inverted bell-shaped arcuate wall 70 that extends upwardly and outwardly at an upper portion of the stand pipe 58 towards the cylindrical sidewall 46. The flared end 68 acts as a flow nozzle that may reduce the pressure drop across the separator 30. The flared end 68 improves separation efficacy by preventing liquid re-entrainment into the dry exhaust air flow that flows through the flared end 68 into the exhaust stand pipe 58. Increasing the effective inner diameter D of the exhaust inlet 64 reduces the axial velocity of the exhaust air as it passes therethrough because the inlet 64 has a larger cross-sectional area than the downstream necked down portion of the exhaust standpipe 58, thereby enhancing separation performance. The slower velocity air stream passing through the exhaust inlet 64 is less prone to re-entraining liquid and debris. Also, reducing the effective distance Z between the outer perimeter of the flared end 68 and the inside surface of the cylindrical sidewall 46 increases the rotational velocity of the working airflow in that region. The higher rotational velocity increases inertial centrifugal force on any dense particles entrained therein and further reduces water and debris re-entrained in the dry exhaust air flow entering the exhaust inlet 64. In a preferred embodiment, the outer perimeter of the flared end 68 protrudes into the high rotational velocity region so that any liquid that may have sheeted up the outer surfaces of the stand pipe 58 will be pulled off of the flared end 68 by the high centrifugal forces in the high rotational velocity airflow region.

Referring back to FIGS. 2-3, a recovery tank 32 is adapted for fluid connection to the separator liquid outlet 56 to collect separated fluid therein. If the centrifugal separator 30 is located remotely from the recovery tank 32 as shown in FIG. 3, the intermediate fluid outlet conduit 57 can be incorporated to fluidly connect the liquid outlet 56 to the recovery tank inlet 59. In one non-limiting configuration, the recovery tank 32 comprises a housing 74 having a sidewall 76, a bottom wall 78, and a lid 80, and further comprises a fluid inlet port 82 protruding upwardly from the lid 80 and terminating at a fluid inlet aperture (not shown). The recovery tank 32 can further comprise a carry handle 86 protruding from the sidewall 76. Alternatively, handle grip features can be formed by indentations in the sidewall 76 or any other suitable handle means. Additional non-limiting recovery tank configurations are contemplated, including a variety of tanks shapes, tanks having removable lids, and the like.

The recovery tank 32 can further comprise a known automatic vacuum shut-off mechanism (not shown) that is actuated when the fluid level inside the recovery tank 32 reaches a predetermined maximum fill level. The shut-off mechanism (not shown) can prevent potential fluid ingestion into the vacuum motor/fan assembly 34 and can comprise a mechanical shut-off float as disclosed in previously referenced U.S. Pat. No. 6,131,237 to Kasper et al. Additional known shut-off means are contemplated such as those incorporating fluid probes, micro-switches, or the like and will not be disclosed in detail herein.

In operation, the extractor 10 is prepared for use by filling the fluid supply tank 22 with cleaning fluid. The extractor 10 is plugged into a power supply whereupon the vacuum motor/fan assembly 34 becomes energized, thus generating a working airflow through the fluid recovery system. Cleaning fluid is selectively delivered to the cleaning surface via the fluid delivery system while the extractor 10 is moved to and fro across the cleaning surface. The working air flows in through the nozzle inlet 38, which is positioned adjacent to or at the cleaning surface. The working air is entrained with water, foam, cleaning solution, and dirt and debris. The working air mixture flows through the nozzle outlet 40 and into a working air conduit 42, whereupon it is delivered to the centrifugal separator 30 through the tangentially positioned separator inlet 54. The working air mixture swirls around the outer portion of the separation chamber 52 as it enters from the inlet 54. While the mixture swirls around the separation chamber 52, centrifugal force acts on the liquid and dense debris, forcing it outwardly towards the cylindrical sidewall 46 while the less dense dry air moves inwardly towards the flared exhaust inlet 64 at the center of the separator 30. The vertically elongated rectangular inlet 54 tends to flatten out the working air mixture to maximize the contact of the mixture with the inner surface of the cylindrical sidewall 46. Friction between the working air mixture and the cylindrical sidewall 46 tends to brake up entrained foam bubbles, thereby releasing the entrapped air and precipitating the moisture against the inner surface of the cylindrical sidewall 46. Gravitational force pulls the dense liquid and debris downwardly to collect the liquid and debris. In addition, the high rotational velocity of working air around the outer perimeter of the flared inlet 64 reduces re-entrainment of liquid in the exhaust airflow. Dry exhaust air is thereby separated from the working air mixture and is drawn inwardly towards the flared exhaust inlet 64.

Upon reaching the flared exhaust inlet 64, the velocity of the dry exhaust air slows, thus making it less prone to re-entrain liquid or debris. The exhaust air is drawn through the exhaust stand pipe 58, to the exhaust outlet 66, through an exhaust conduit 36, and eventually through the vacuum motor/fan assembly 34, where the air is then exhausted into the atmosphere through the vent 13 in the foot assembly 12. The separated liquid and dirt slurry flows through the separator liquid outlet aperture 52, through the outlet 56, and into the recovery tank 32 through the fluid inlet port 82. Optionally, an intermediate conduit 57 or hose can be incorporated to fluidly connect the separator liquid outlet 56 to the fluid inlet port 82, thereby adapting to a plethora of architectural options with respect to the position of the separator 30 and recovery tank 32 on the foot 12, handle 14, or combination thereof. When the fluid level within the recovery tank 32 rises to a predetermined fill level, a shut-off mechanism (not shown) is actuated to close off the exhaust inlet 64 or turn off the motor to interrupt the working air flow in a known manner. After disconnecting the power supply to the device, a user can grasp the recovery tank 32 via the carry handle 86 and detach the fluid inlet port 82 from the separator liquid outlet 56. A user can then invert the recovery tank 32 to pour the separated liquid and dirt out of the fluid inlet port 82 prior to replacing the recovery tank onto one of the foot 12 or handle assembly 14 for repeated use.

Figure 7:
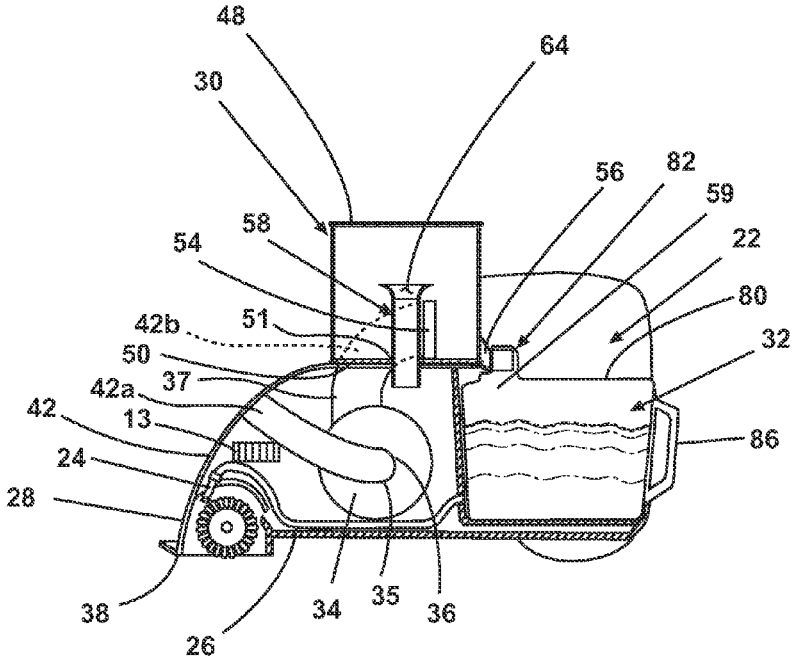
FIG. 7 is a schematic partial side elevational view, like FIG. 3, of an upright extraction cleaning machine according to a third embodiment of the invention.

Referring now to FIG. 7, where like numerals are used to describe like parts, the suction nozzle 28 is fluidly connected to the fan inlet 35 of the vacuum/motor fan assembly 34 through a working air conduit 42*a*. The vacuum/motor fan assembly 34 fan outlet 37 is fluidly connected to the separator inlet 54 through a working air conduit 42*b*. In addition, the exhaust standpipe 58 has an open bottom end that extends into the housing of the foot assembly 12 and is vented to the atmosphere through vent 13. Thus, in this embodiment, the suction source (vacuum/motor fan assembly 34) draws liquid-laded air and debris from the suction nozzle 28, pressurizes it and passes it under pressure to the separator inlet 54 of the recovery tank. The separator then functions like the embodiments disclosed above with respect to FIGS. 1-6.

While the invention has been specifically described in connection with certain specific embodiments thereof, it is to be understood that this is by way of illustration and not of limitation, and the scope of the appended claims should be construed as broadly as the prior art will permit. Reasonable variation and modification are possible within the foregoing description and drawings without departing from the spirit of the invention which is defined in the appended claims.

What is claimed is:

1. An extraction cleaning apparatus adapted for movement across a surface to be cleaned comprising:

a fluid delivery system including a fluid distributor and a fluid supply tank fluidly connected thereto, the fluid distributor being adapted to deliver cleaning fluid from the fluid supply tank to the surface to be cleaned;

a fluid recovery system comprising:

a suction nozzle having a suction nozzle inlet adapted to recover cleaning fluid and debris from the surface to be cleaned and a suction nozzle outlet opening;

a recovery tank adapted to collect liquid and debris and having an inlet;

a centrifugal separator comprising:

a cylindrical housing defining a separation chamber and having:

a separator inlet fluidly positioned at a lower portion of the cylindrical housing and connected to the suction nozzle outlet opening, the separator inlet comprising an inlet opening in the cylindrical housing and an inlet conduit that introduces the air and liquid into the separation chamber at a tangential angle to the separation chamber through the inlet opening, the inlet conduit having elongate sidewalls, a top wall, and a bottom wall defining a rectangular cross-section;

a separator liquid outlet in a lower portion of the cylindrical housing, spaced from the separator inlet and in fluid communication with the recovery tank inlet, the separator liquid outlet comprising a rectangular liquid outlet opening in the cylindrical housing of substantially the same shape and size as the inlet opening, wherein the liquid outlet opening is substantially diametrically opposed to the inlet opening;

an air outlet in a bottom portion of the separation chamber for exhausting air from the separation chamber; and an exhaust stand pipe within the separation chamber in fluid communication with the air outlet and extending upwardly therefrom to an open upper end to exhaust air separated from liquid in the separation chamber, wherein the open upper end is above the entire inlet opening and the entire liquid outlet opening; and a suction source in fluid communication with the suction nozzle and the cylindrical separator and adapted to draw air, soiled cleaning fluid and debris from the surface to be cleaned through the suction nozzle and pass the same into the separation chamber.

2. The extraction cleaning apparatus according to claim 1 wherein the suction source is positioned downstream of the separation chamber.

3. The extraction cleaning apparatus according to claim 1 wherein the suction source is positioned upstream of the separation chamber.

4. The extraction cleaning apparatus according to claim 1 wherein the cylindrical housing includes a sidewall defining the separation chamber, the inlet opening is formed in the sidewall, and the inlet conduit meets the sidewall at the inlet opening.

5. The extraction cleaning apparatus according to claim 4 wherein the inlet opening is an axially elongated rectangular aperture wherein the long dimension of the opening is parallel to the central axis of the separation chamber.

6. The extraction cleaning apparatus according to claim 5 wherein the height-to-width ratio of the cross-sectional dimensions of the axially elongated rectangular aperture is in the range of 2:1 to 50:1.

7. The extraction cleaning apparatus according to claim 5 wherein the height-to-width ratio of the cross-sectional dimensions of the axially elongated rectangular aperture is in the range of 20:1 to 40:1.

8. The extraction cleaning apparatus according to claim 1 wherein the liquid outlet also includes an outlet conduit that extends from the cylindrical housing at a tangential angle to the separation chamber.

9. The extraction cleaning apparatus according to claim 8 wherein the separator inlet is positioned higher in the separation chamber than the liquid outlet.

10. The extraction cleaning apparatus according to claim 9 wherein the separator inlet is positioned about 180° from the liquid outlet about the cylindrical housing.

11. The extraction cleaning apparatus according to claim 9 wherein the exhaust stand pipe is flared outwardly at the open upper end thereof.

12. The extraction cleaning apparatus according to claim 1 wherein the separator inlet is positioned higher in the separation chamber than the liquid outlet.

13. The extraction cleaning apparatus according to claim 12 wherein the separator inlet is positioned about 180° from the liquid outlet about the cylindrical housing.

14. The extraction cleaning apparatus according claim 1 wherein the exhaust stand pipe is flared outwardly at the open upper end thereof.

15. The extraction cleaning apparatus according to claim 14 wherein the separator inlet is positioned about 180° from the liquid outlet about the cylindrical housing.

16. The extraction cleaning apparatus according to claim 8 wherein the outlet conduit comprises elongate sidewalls, a top wall, and a bottom wall defining a rectangular cross-section.

17. The extraction cleaning apparatus according to claim 16 wherein the bottom wall of the inlet conduit is above a bottom wall of the cylindrical housing and the bottom wall of the outlet conduit is at least one of co-planar with and below the bottom wall of the cylindrical housing.

18. The extraction cleaning apparatus according to claim 1 wherein the top and bottom walls of the inlet conduit are perpendicular to the central axis of the separation chamber and the side walls of the inlet conduit are parallel to the central axis of the separation chamber.

* * * * *